US009188948B2

(12) United States Patent
Okauchi

(10) Patent No.: US 9,188,948 B2
(45) Date of Patent: Nov. 17, 2015

(54) IMAGE FORMING APPARATUS

(71) Applicant: KYOCERA Document Solutions Inc., Osaka (JP)

(72) Inventor: Yoshifumi Okauchi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/499,664

(22) Filed: Sep. 29, 2014

(65) Prior Publication Data

US 2015/0098722 A1 Apr. 9, 2015

(30) Foreign Application Priority Data

Oct. 9, 2013 (JP) ..... 2013-211528

(51) Int. Cl.

| | |
|---|---|
| ***G03G 21/16*** | (2006.01) |
| ***B65H 5/00*** | (2006.01) |
| ***B65H 7/20*** | (2006.01) |
| ***G03G 15/00*** | (2006.01) |

(52) U.S. Cl.

CPC ..... *G03G 21/1652* (2013.01); *B65H 5/00* (2013.01); *B65H 7/20* (2013.01); *G03G 15/80* (2013.01); *G03G 21/1695* (2013.01)

(58) Field of Classification Search

CPC ..... G03G 21/1652; G03G 15/80; G03G 21/1695; G03G 2215/00383; G03G 2215/00978; B65H 5/00; B65H 7/20

See application file for complete search history.

(56) References Cited

U.S. PATENT DOCUMENTS

| | | | | |
|---|---|---|---|---|
| 5,940,116 | A * | 8/1999 | Park et al. | 347/263 |
| 8,295,729 | B2 | 10/2012 | Okauchi | |
| 2011/0243577 | A1* | 10/2011 | Marumoto | 399/2 |
| 2013/0164020 | A1* | 6/2013 | Matsuno | 399/90 |

FOREIGN PATENT DOCUMENTS

| | | | |
|---|---|---|---|
| JP | H06-23946 | U | 3/1994 |
| JP | H07-295319 | A | 11/1995 |

* cited by examiner

*Primary Examiner* — Joseph S Wong
(74) *Attorney, Agent, or Firm* — Studebaker & Brackett PC

(57) ABSTRACT

An image forming apparatus includes an apparatus main body part and a sheet feed unit installed below the apparatus main body part, which include connector parts electrically connecting the apparatus main body part and sheet feed unit. The connector part at a side of the apparatus main body part includes a window; a first connector main body visible through the window and having an electrical connection port facing to the sheet feed unit; a connector cover covering openably/closably the electrical connection port of the first connector main body; and a biasing member biasing the first connector main body downwardly. The connector part at a side of the sheet feed unit includes a second connector main body positioned below the first connector main body. The first connector main body is pressured downwardly with respect to the connector cover by the biasing member, when the connector cover is closed.

5 Claims, 9 Drawing Sheets

IMAGE FORMING APPARATUS

INCORPORATION BY REFERENCE

This application is based on and claims the benefit of priority from Japanese Patent application No. 2013-211528 filed on Oct. 9, 2013, the entire contents of which are incorporated herein by reference.

BACKGROUND

The present disclosure relates to an image forming apparatus including a sheet feeding device as an option device installed below an apparatus main body part having an image forming part.

In an image forming apparatus, a sheet feeding device may be added below an apparatus main body having an image forming part. When the sheet feeding device is added, the image forming apparatus becomes possible to deal with various sheet sizes and to feed a large number of sheets.

The apparatus main body and sheet feeding device are not only mechanically connected, but also electrically connected by connectors respectively provided on a bottom face of the apparatus main body and on a top face of the sheet feeding device in order to communicate control signal and to supply power. In such a case, because the connector of the apparatus main body is provided on the bottom face, there are problems that it is hard for a worker to visually confirm a position of the connector and to correctly connect the connector when the sheet feeding device is installed. In general, the connector of the apparatus main body is protected by a connector cover, if the installation of the sheet feeding device were tried by mistake while the connector cover is removed, there are possibilities that a protrusion, such as a guide pin, arranged near the connector of the sheet feeding device hits against the connector of the apparatus main body by mistake, and then, malfunction, such as damage of a connector housing, occurs.

Thereupon, there is an image forming apparatus connecting the connector of the apparatus main body and the connector of the sheet feeding device by interlocking with an action mechanically aligning positions of the apparatus main body and sheet feeding device. Alternatively, there is an image forming apparatus, in which the sheet feeding device includes an aligning pin and the apparatus main body includes an aligning guide guiding the aligning pin, and then, when the apparatus main body is placed onto the sheet feeding device in a state where the aligning pin is engagingly stopped with the aligning guide, the connector of the apparatus main body and the connector of the sheet feeding device are connected.

However, in a case of connecting the connectors by interlocking the aligning of the positions of the apparatus main body and sheet feeding device or by using the aligning pin and aligning guide, because the connecting work is carried out without visually confirming the position of the connector actually, it is hard to grasp whether or not the connection is sure. Moreover, there is a possibility that the protrusion at a side of the sheet feeding device comes into contact with the connector at a side of the apparatus main body when the positions of the apparatus main body and sheet feeding device are aligned.

SUMMARY

In accordance with an embodiment of the present disclosure, an image forming apparatus includes an apparatus main body part including an image forming part and a sheet feed unit installed below the apparatus main body part. The apparatus main body part and sheet feed unit include connector parts electrically connecting the apparatus main body part and sheet feed unit in a bottom face and a top face respectively. The connector part at a side of the apparatus main body part includes a window formed at a side face of the apparatus main body part, a first connector main body located at a position visible through the window and having an electrical connection port facing to the sheet feed unit, a connector cover covering openably/closably the electrical connection port of the first connector main body and a biasing member biasing the first connector main body downwardly. The connector part at a side of the sheet feed unit includes a second connector main body positioned below the first connector main body and electrically connected to the first connector main body. The first connector main body is pressured downwardly with respect to the connector cover by the biasing member, when the connector cover is closed.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference the drawings, an image forming apparatus according to an embodiment of the present disclosure will be described.

Figure 1:
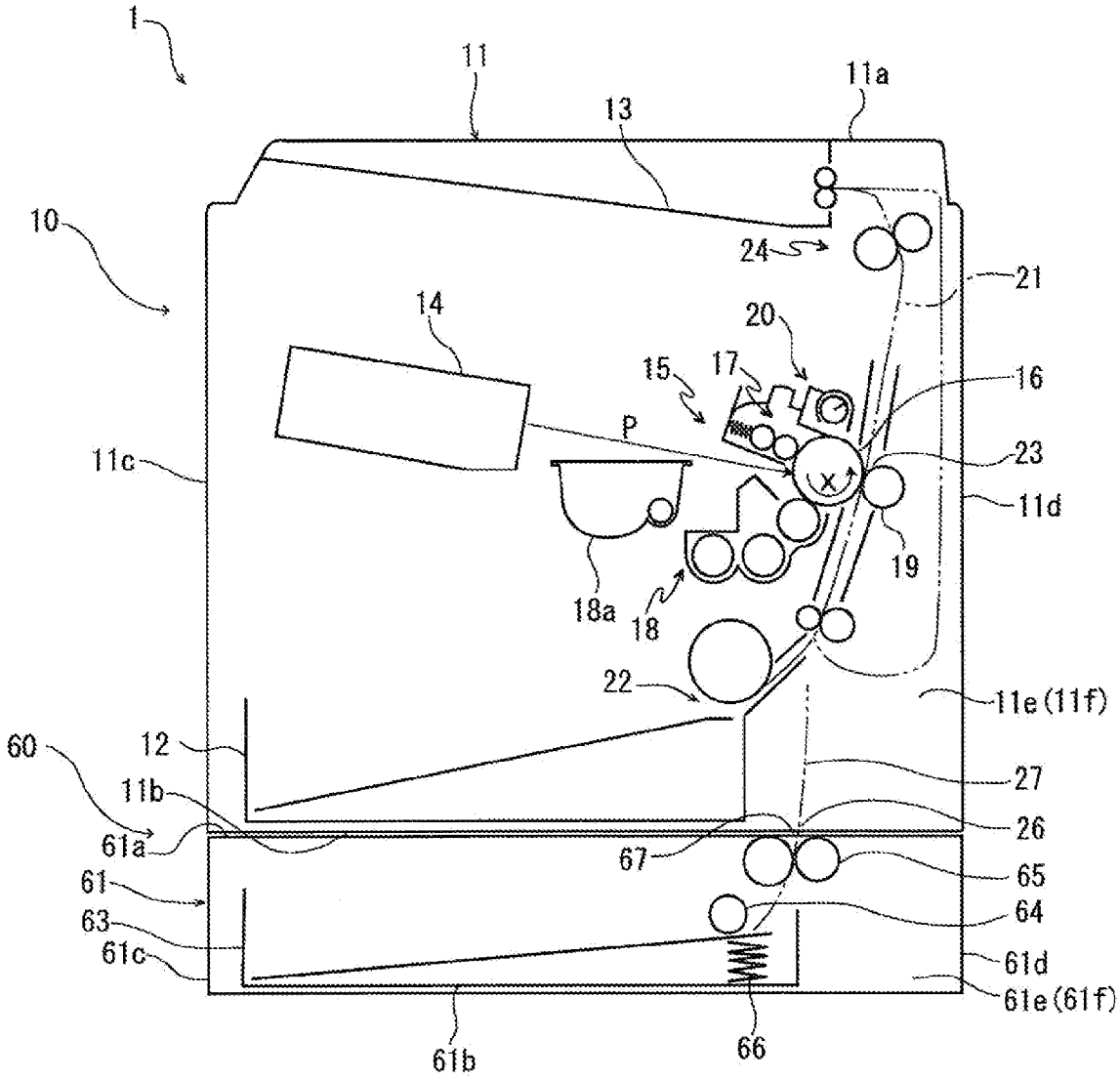
FIG. 1 is a schematic diagram schematically showing a structure of a printer in accordance with an embodiment of the present disclosure.
Figure 2:
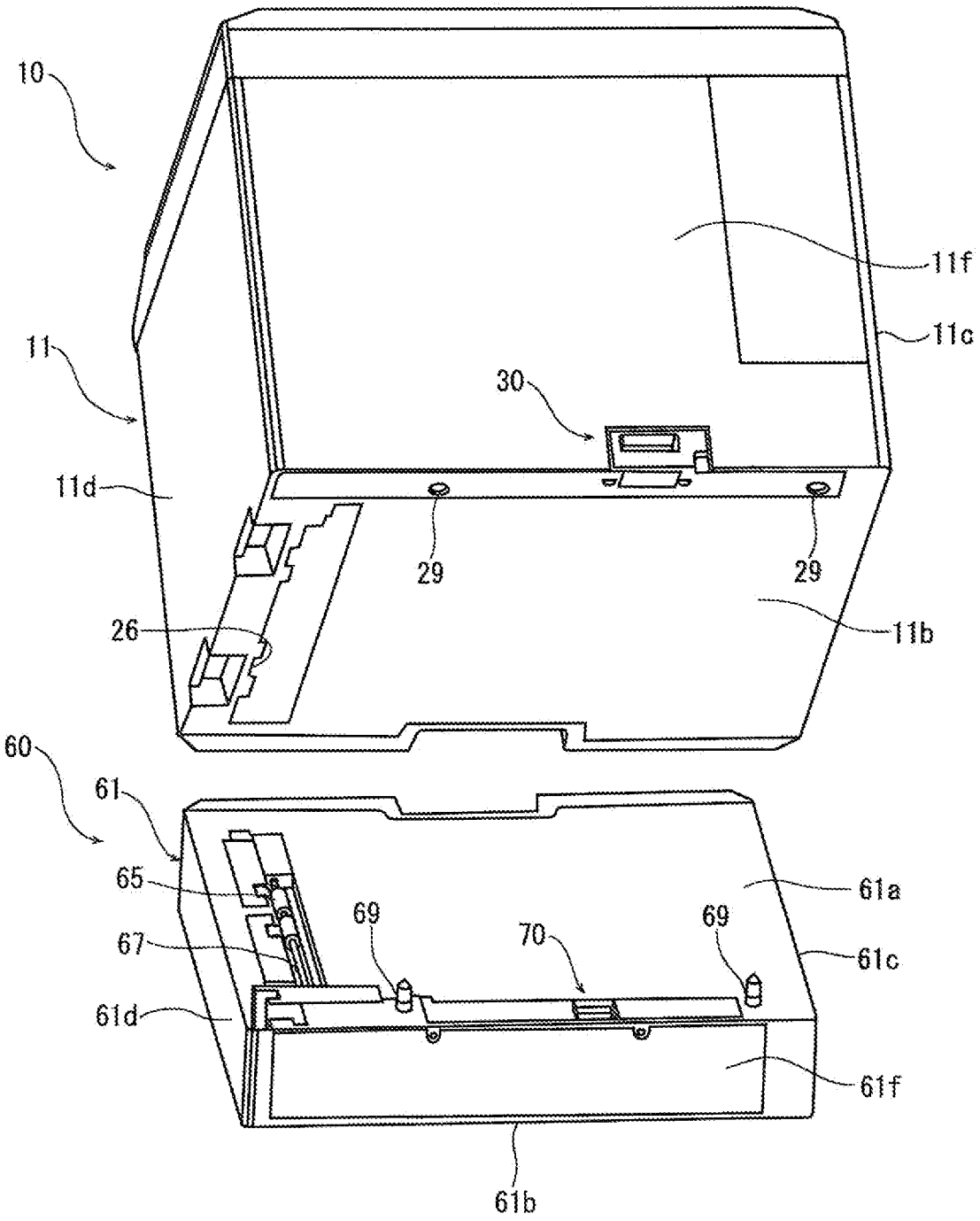
FIG. 2 is an exploded perspective view showing the printer, as viewed from a back side, in accordance with the embodiment of the present disclosure.

With reference to FIGS. 1 and 2, a printer as the image forming apparatus according to the embodiment of the present disclosure will be described. FIG. 1 is a front view showing the printer. FIG. 2 is an exploded perspective view showing the printer as viewed from a back side. The printer 1 includes an apparatus main body part 10 having an image forming part and a sheet feed unit 60 installed below the apparatus main body part 10. In FIG. 1, the near side on a paper plane indicates the front side of the printer 1 and orthogonal directions to forward and backward directions indicate left and right directions.

The apparatus main body part 10 includes a box-formed a casing 11. The casing 11 has a top plate 11*a* and a bottom plate 11*b* (a bottom face), side plates 11*c* and 11*d* facing to each other in the left and right directions, and a front plate 11*e* and a rear plate 11*f* facing to each other in the forward and backward directions. In a lower part of the inside of the casing 11, a sheet feeding cartridge 12 storing a sheet (not shown) is provided and, in the top plate 11*a* of the casing 11, a sheet ejected tray 13 is formed.

Inside the casing 11, an exposure device 14 composed of a laser scanning unit (LSU) is located and, at one side of the exposure device 14, an image forming part 15 is provided. In the image forming part 15, a photosensitive drum 16 as an image carrier is rotatably arranged. Around the photosensitive drum 16, a charger 17, a development unit 18 connected to a toner case 18*a*, a transferring roller 19 and a cleaning device 20 are located along a rotating direction (refer to an arrow X in FIG. 1) of the photosensitive drum 16.

Inside the casing 11, a conveying path 21 for the sheet is arranged from the sheet feeding cartridge 12 to the sheet ejected tray 13. At an upstream end in the conveying path 21, a sheet feeding part 22 is positioned. At an intermediate stream part in the conveying path 21, a transferring part 23 composed of the photosensitive drum 16 and transferring roller 19 is positioned. At a downstream part in the conveying path 21, a fixing device 24 is positioned.

As shown in FIG. 2 in addition to FIG. 1, in the bottom plate 11*b* of the casing 11, a reception port 26 receiving the sheet fed from the sheet feed unit 60 is formed. Inside the casing 11, a feeding sheet conveying path 27 is arranged from the reception port 26 to the conveying path 21. Further, as shown in FIG. 2, along a rear edge of the bottom plate 11*b* of the casing 11, two aligning holes 29 are bored.

As shown in FIG. 2, at a corner between the rear plate 11*f* and bottom pate 11*b* of the casing 11, a connector part 30 electrically connected to the sheet feed unit 60 is provided. The connector part 30 will be described later.

Next, the operation of forming an image by the apparatus main body part 10 having such a configuration will be described.

When the power is supplied to the apparatus main body part 10, various parameters are initialized and initial determination, such as temperature determination of the fixing device 24, is carried out. Subsequently, in the apparatus main body part 10, when image data is inputted and a printing start is directed from a computer or the like connected with the apparatus main body part 10, image forming operation is carried out as follows.

First, the surface of the photosensitive drum 16 is electric-charged by the charger 17. Then, exposure corresponding to the image data on the photosensitive drum 16 is carried out by a laser light (refer to an arrow P in FIG. 1) from the exposure device 14, thereby forming an electrostatic latent image on the surface of the photosensitive drum 16. Subsequently, the electrostatic latent image is developed by the development unit 18, and thereby, a toner (developer) image is generated.

On the other hand, a sheet fed from the sheet feeding cartridge 13 by the sheet feeding part 22 is conveyed to the transferring part 23 in a suitable timing for the above-mentioned image forming operation, and then, the toner image on the photosensitive drum 16 is transferred onto the sheet in the transferring part 23. The sheet with the transferred toner image is conveyed to a downstream side in the conveying path 21 to go forward to the fixing device 24, and then, the toner image is fixed on the sheet in the fixing device 24. The sheet with the fixed toner image is ejected from the downstream end in the conveying path 21 to the sheet ejected tray 14. The toner remained on the photosensitive drum 16 is collected by the cleaning device 20.

Next, the sheet feed unit 60 will be described. The sheet feed unit 60 is provided with a laterally long flat box-formed casing 61 and installed below the casing 11 of the apparatus main body part 10. The casing 61 has a top plate 61*a* (a top face) and a bottom plate 61*b*, side plates 61*c* and 61*d* facing to each other in the left and right directions, and a front plate 61*e* and a rear plate 61*f* facing to each other in the forward and backward directions. Inside the casing 61, a tray 63 storing the sheet, a sheet feeding roller 64 feeding the sheet from the tray 63, a pair of conveying rollers 65 conveying the sheet to the feeding sheet conveying path 27 of the apparatus main body part 10 and a biasing part 66 biasing the sheet to the sheet feeding roller 64 are arranged.

In the top plate 61*a* of the casing 61, an ejection port 67 ejecting the sheet conveyed by the conveying rollers 65 is formed. As shown in FIG. 2, the ejection port 67 is positioned so as to correspond to the reception port 26 formed in the bottom plate 11*b* of the casing 11 of the apparatus main body part 10. Along a rear edge of the top plate 61*a* of the casing 61, two aligning pins 69 protruding upwardly are vertically arranged.

In the top plate 61*a* of the casing 61, a connector part 70 corresponding to the connector part 30 of the apparatus main body part 10 is provided. The connector part 70 will be described later.

Figure 3:
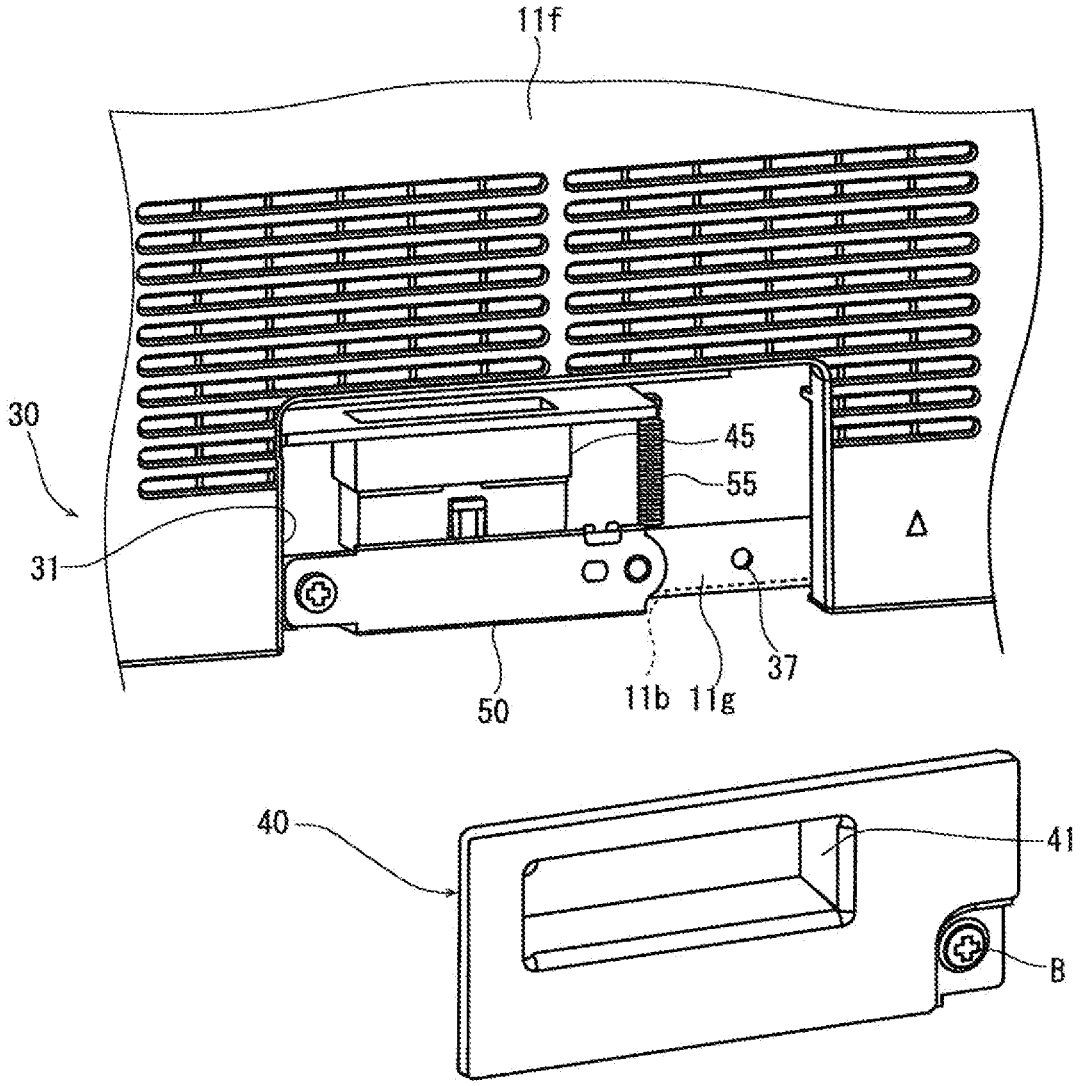
FIG. 3 is a perspective view showing a connector part of an apparatus main body part of the printer, as viewed from a back side of the apparatus main body part, in accordance with the embodiment of the present disclosure.
Figure 4:
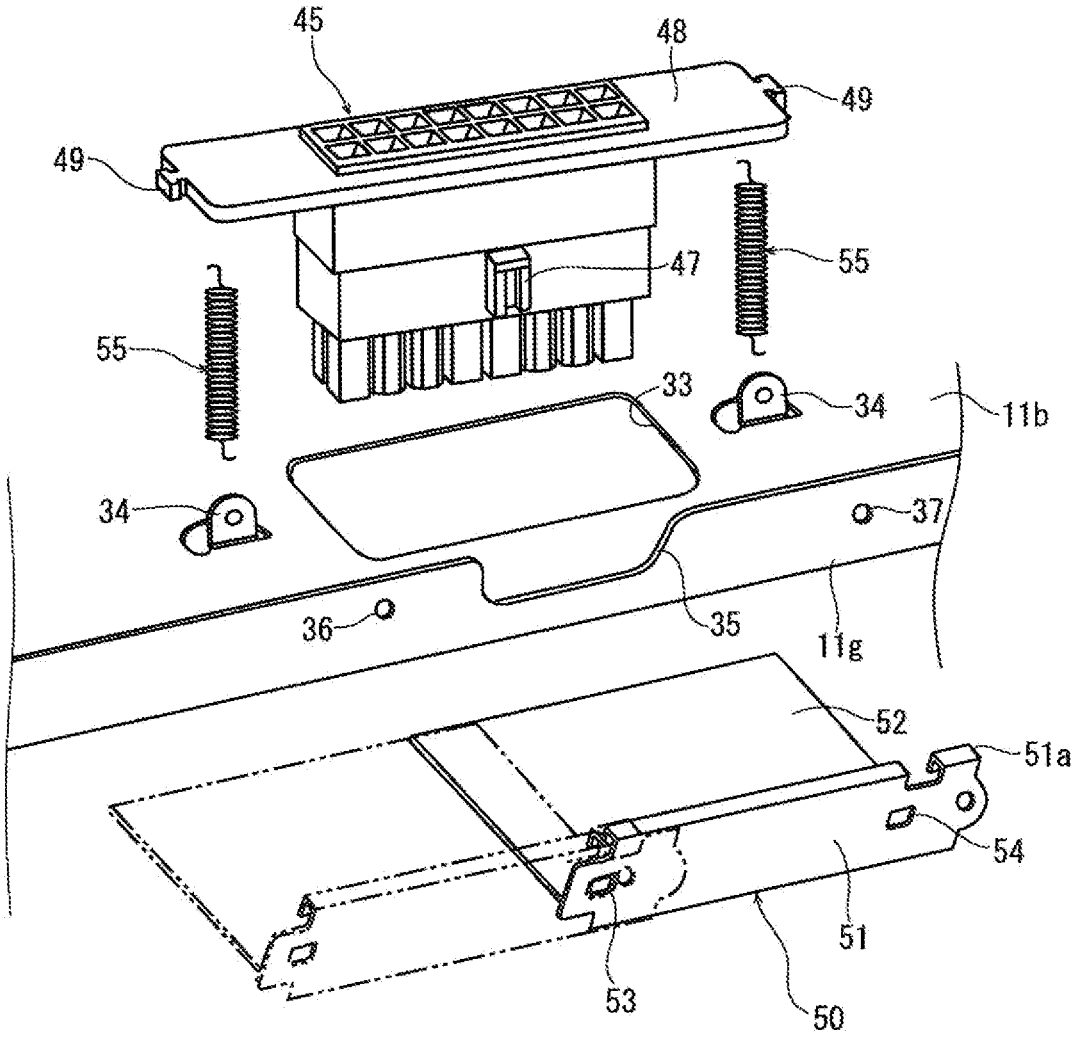
FIG. 4 is an exploded perspective view showing the connector part of the apparatus main body part of the printer, as viewed from a back side of the apparatus main body part, in accordance with the embodiment of the present disclosure.
Figure 5A:
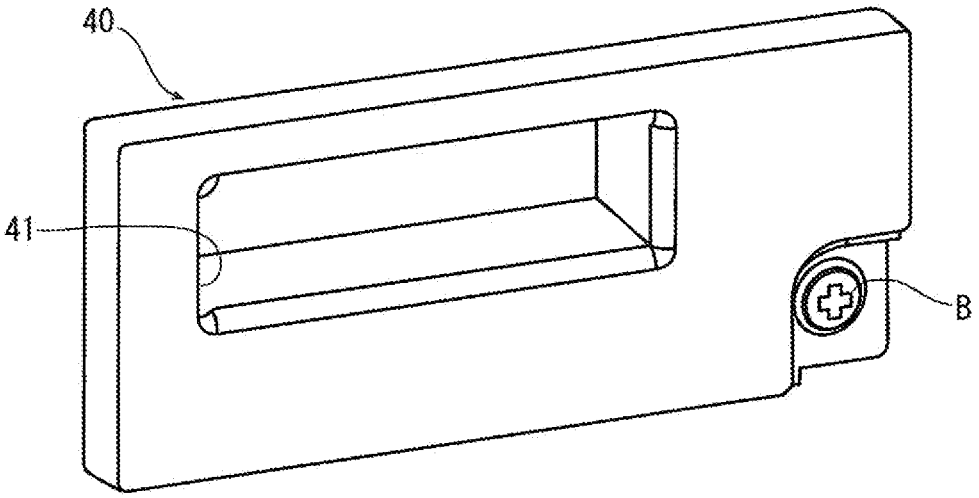
FIGS. 5A and 5B are perspective views showing a window cover of the connector part of the apparatus main body part of the printer, as viewed from a front side and a back side respectively, in accordance with the embodiment of the present disclosure.
Figure 5B:
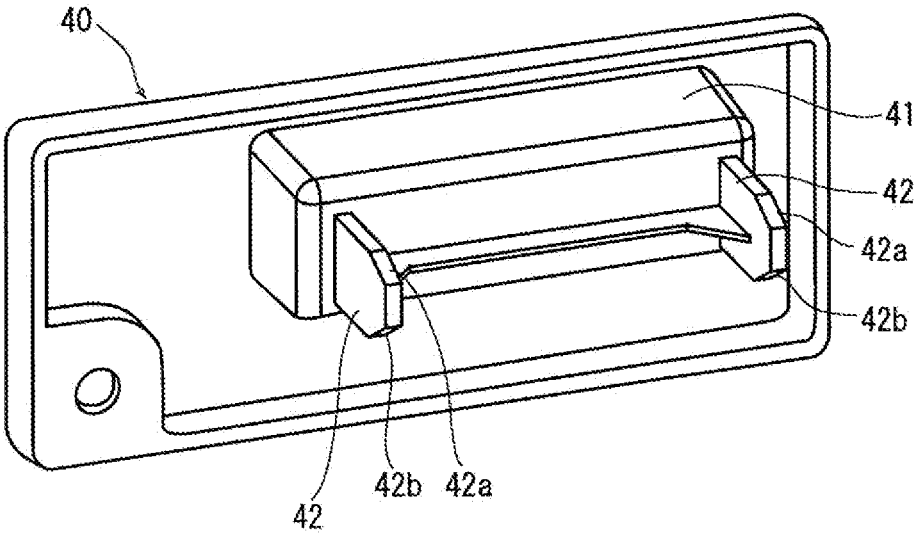
Figure 6:
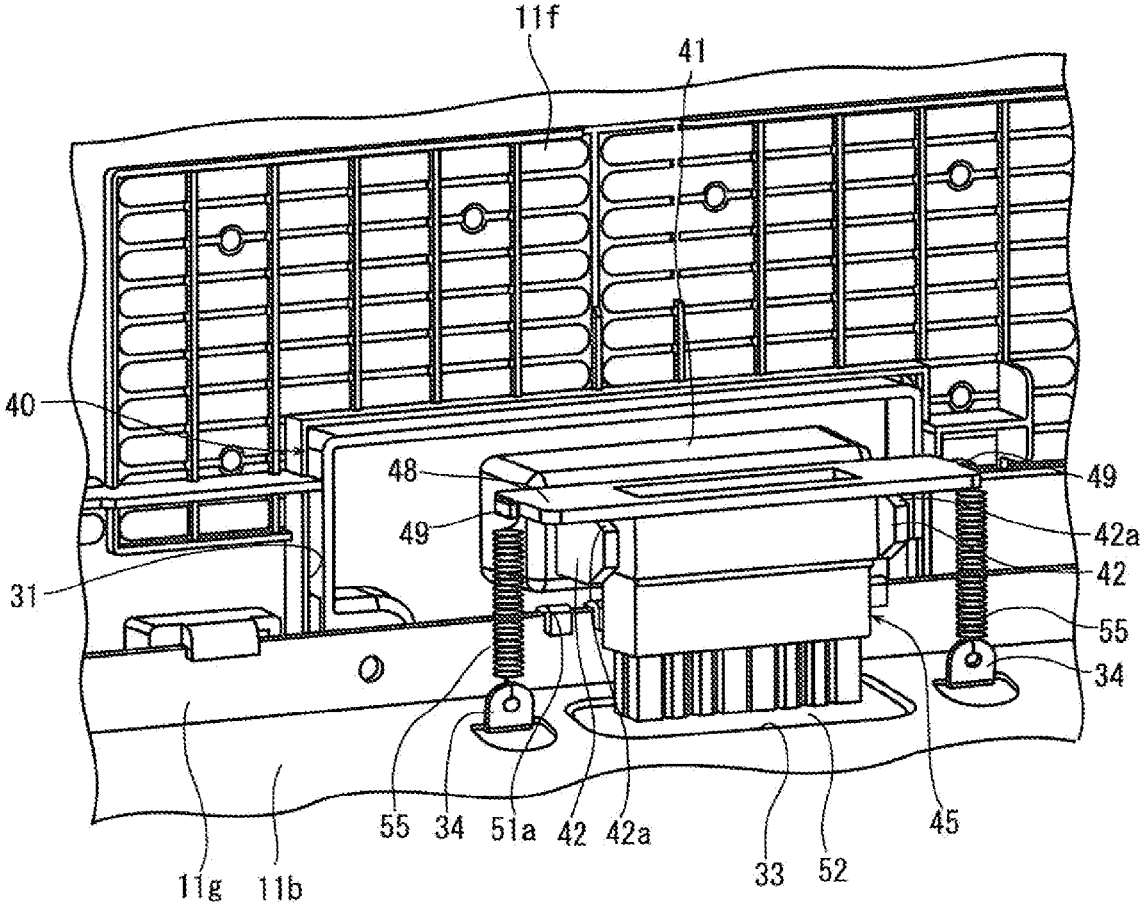
FIG. 6 is a perspective view showing the connector part of the apparatus main body part of the printer, as viewed from the inside of the apparatus main body part, in accordance with the embodiment of the present disclosure.

Next, with reference to FIGS. 3-7, the connector part 30 of the apparatus main body part 10 will be described. FIG. 3 is a perspective view showing the connector part as viewed from a back side of the apparatus main body part. FIG. 4 is an exploded perspective view showing the connector part as viewed from a back side of the apparatus main body part. FIGS. 5A and 5B are perspective views showing a window cover as viewed from a front side and a back side respectively. FIG. 6 is a perspective view showing the connector part as viewed from the inside of the apparatus main body part. Hereinafter, the connector part will be described as viewed from the back side of the apparatus main body part 10 and sheet feed unit 60. The left and right directions and the front and back in the description indicate the directions as viewed from the back side of the apparatus main body part 10 and sheet feed unit 60.

As shown in FIG. 3, the connector 30 has a window 31 formed in the rear plate 11*f* of the casing 11, a window cover 40 covering openably/closably the window 31, a male connector 45 (a first connector main body) located at a position visible through the window 31, a connector cover 50 covering openably/closably an electrical connection port of the male connector 45 and coil springs 55 (biasing members) biasing the male connector 45 downwardly.

The window 31 is a laterally long rectangular like opening formed continuously from a lower edge of the rear plate 11*f* of the casing 11. The lower edge of the rear plate 11*f* of the casing 11 is engaged with an edge part 11*g* vertically arranged from an outer circumference of the bottom plate 11*b* of the casing 11 by a hook or the like. As shown in FIG. 4, the bottom plate 11*b* of the casing 11 is formed with an opening part 33 at a position corresponding to the window 31. At the left and right sides of the opening part 33, hook engagingly stop parts 34 are vertically arranged from the bottom plate 11*b*. The edge part 11*g* of the bottom plate 11*b* is formed with a concaved notch part 35 at a position corresponding to the window 31. At the left and right sides of the notch part 35, screw holes 36 and 37 are bored respectively.

As shown in FIG. 3, the window cover 40 has a similar shape as the window 31 to be fitted into the window 31 and is fastened to the casing 11 by screwing a screw B with the right screw hole 37 formed in the edge part 11*g* of the bottom plate 11*b* of the casing 11. As shown in FIGS. 5A and 5B, in a front face of the window cover 40, a concaved part 41 as a pull is formed. As shown in FIG. 5B, on a back face of the concaved part 41, vertical ribs 42 are formed. The vertical ribs 42 are extended in parallel from left and right end portions of the back face of the concaved part 41. The vertical rib 42 is formed in a tapered shape to have tapered upper and lower faces 42*a* and 42*b*.

As shown in FIG. 4, the male connector 45 is formed in a rectangular parallelepiped like shape to have an upper face and a lower face having the electrical connection port electrically connected to the connector part 70 of the sheet feed unit 60. Into the upper face, terminals (not shown) of a power supply line extending from a power source and a signal line extending from a controlling part in the apparatus main body part 10 are inserted. The male connector 45 is positioned so that the electrical connection port faces to the opening part 33 bored in the bottom plate 11*b* of the casing 11. On a front face of the male connector 45, a hook part 47 is formed. The top face of the male connector 45 has flange parts 48 overhung in the left and right directions. The flange parts 48 are formed with hook engagingly stop parts 49 at the left and right ends.

As shown in FIG. 4, the connector cover 50 is a member having a side face formed in an L-shape to have a vertical part 51 extending vertically and a horizontal part 52 bent from a lower edge of the vertical part 51 backwardly at roughly right angles. A height of the vertical part 51 is roughly equal to a height of the edge part 11*g* of the bottom plate 11*b* of the casing 11. Along an upper edge of a back face of the vertical part 51, a groove part 51*a* is formed. At the left and right end portions of the vertical part 51, through holes 53 and 54 are bored. The horizontal part 52 has a size covering the opening part 33 formed in the bottom plate 11*b* of the casing 11.

The connector cover 50 is positioned at the outside of the corner between the bottom plate 11*b* and edge part 11*g* of the casing 11. Then, the groove part 51*a* of the vertical part 51 is meshed with an upper edge of the edge part 11*g* of the bottom plate 11*b* of the casing 11 and the horizontal part 52 is extended along a lower face of the bottom plate 11*b*. When the connector cover 50 is slid in the left and right direction along the edge part 11*g*, the opening part 33 formed in the bottom plate 11*b* is opened and closed by the horizontal part 52. In a case where the connector cover 50 is located at an opening part closed position (a position to be withdrawn from the connecting part and to expose the connecting part), by adjusting the left through hole 53 of the vertical part 51 to the left screw hole 36 of the edge part 11*g* of the bottom plate 11*b* of the casing 11 and by screwing the screw with the left through hole 53 and left screw hole 36, the connector cover 50 is fastened to the edge part 11*g*. In a case where the connector cover 50 is located at an opening part opened position (indicated by a two-dot chain line in FIG. 4, i.e., a position to cover the connecting part), by adjusting the right through hole 54 of the vertical part 51 to the left screw hole 36 of the edge part 11*g* of the bottom plate 11*b* of the casing 11 and by screwing the screw with the right through hole 54 and left screw hole 36, the connector cover 50 is fastened to the edge part 11*g*.

The coil spring 55 supports the male connector 45 to the bottom plate 11*b* of the casing 11 and biases the male connector 45 downwardly. As shown in FIG. 4, the coil spring 55 is bridged between the hook engagingly stop part 49 formed in the flange part 48 and hook engagingly stop part 34 formed in the bottom plate 11*b* of the casing 11.

In a condition that the sheet feed unit 60 is not installed, in the apparatus main body part 10, as shown in FIG. 6, the connector cover 50 is slid to the opening part closed position and the opening part 33 of the bottom plate 11*b* of the casing 11 is closed by the horizontal part 52 of the connector cover 50. Moreover, the window 31 is closed by the window cover 40. At this time, the vertical rib 42 formed on the back face of the concaved part 41 of the window cover 40 is inserted below the flange part 48 to support the male connector 45 against a biasing force of the coil spring 55. Thereby, the male connector 45 is pressured downwardly and takes a posture of the electrical connection port being not connected to the connector cover 50, or alternatively, a posture of the electrical connection port pressured to the connector cover 50 with an extremely weak force.

Figure 7:
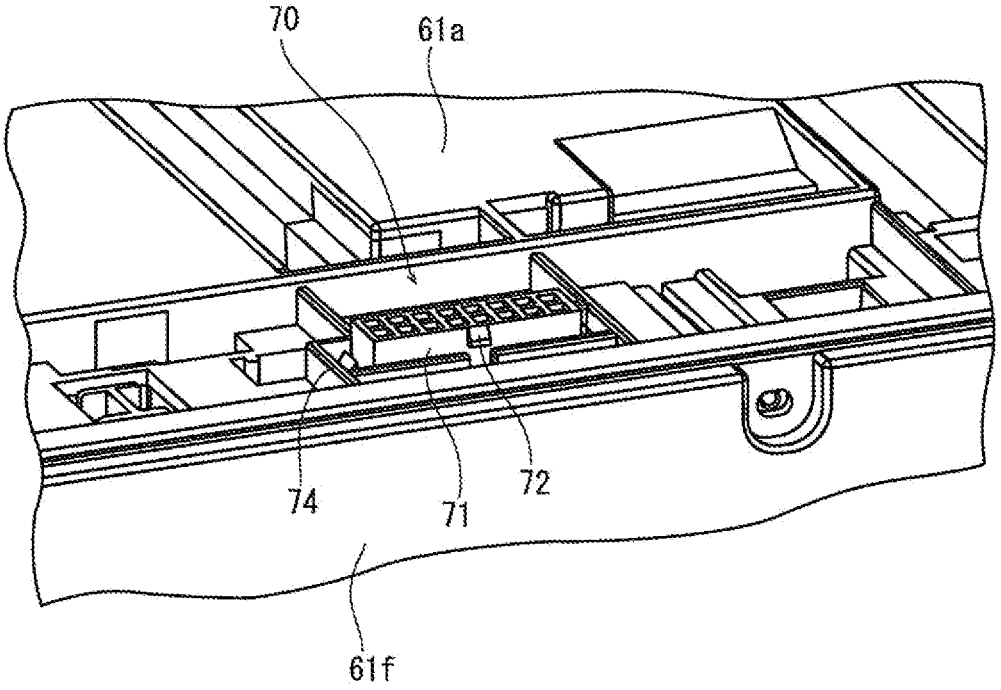
FIG. 7 is a perspective view showing a connector part of a sheet feed unit of the printer, as viewed from a back side of the apparatus main body part, in accordance with the embodiment of the present disclosure.

Next, the connector part 70 of the sheet feed unit will be described with reference to FIGS. 2 and 7. FIG. 7 is a perspective view showing the connector part as viewed from a back side. As shown in FIG. 2, the connector part 70 is formed at a position facing to the connector part 30 of the apparatus main body part 10.

As shown in FIG. 7, the connector part 70 has a female connector 71 (a second connector main body) connected to the male connector 45 of the connector part 30 of the apparatus main body part 10. The female connector 71 is formed in a rectangular parallelepiped like shape to have a lower face and an upper face having an electrical connection port electrically connected to the male connector 45 of the connector part 30 of the apparatus main body part 10. Into the lower face, terminals of a plurality of signal lines and power supply lines extending from the rollers and others of the sheet feed unit are inserted. In a front face of the female connector 71, a hook part 72 is formed. The female connector 71 is located so that the electrical connection port is positioned below the face of the top plate 61*a* of the casing 61, and is surrounded by a plurality of ribs 74 vertically arranged from the top plate 61*a*.

In the rear plate 61*f* of the casing 61, a hook (not shown) is turnably supported in order to lock the male connector 45 of the apparatus main body part 10 and the female connector 71 of the sheet feed unit 60 when both connectors are connected. The hook part 47 of the male connector 45 is an arm-like member, is elastically joined to the side face of the male connector 45 at a portion between a leading end part at a female connector side and a base end part at an opposite side to the male connector 45, and is swingable by elastic deformation of the jointed portion. The leading end part has a hook shape. When the male connector 45 and female connector 71 are connected, the hook of the leading end part of the hook part 47 of the male connector 45 is engaged with the hook part 72 of the female connector 71, thereby locking the male connector 45 and female connector 71 in a connection state.

Figure 8A:
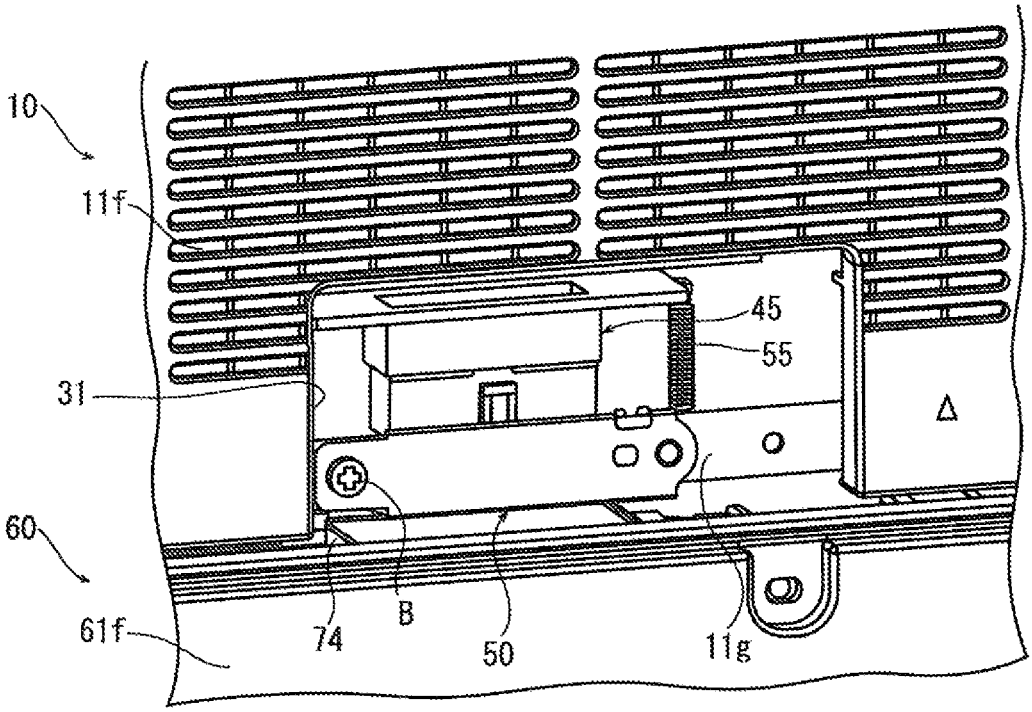
FIGS. 8A and 8B are perspective views showing the printer, as viewed from the outside of the apparatus main body part, in respective situations where a connector cover of the apparatus main body part is closed and opened, in accordance with the embodiment of the present disclosure.
Figure 8B:
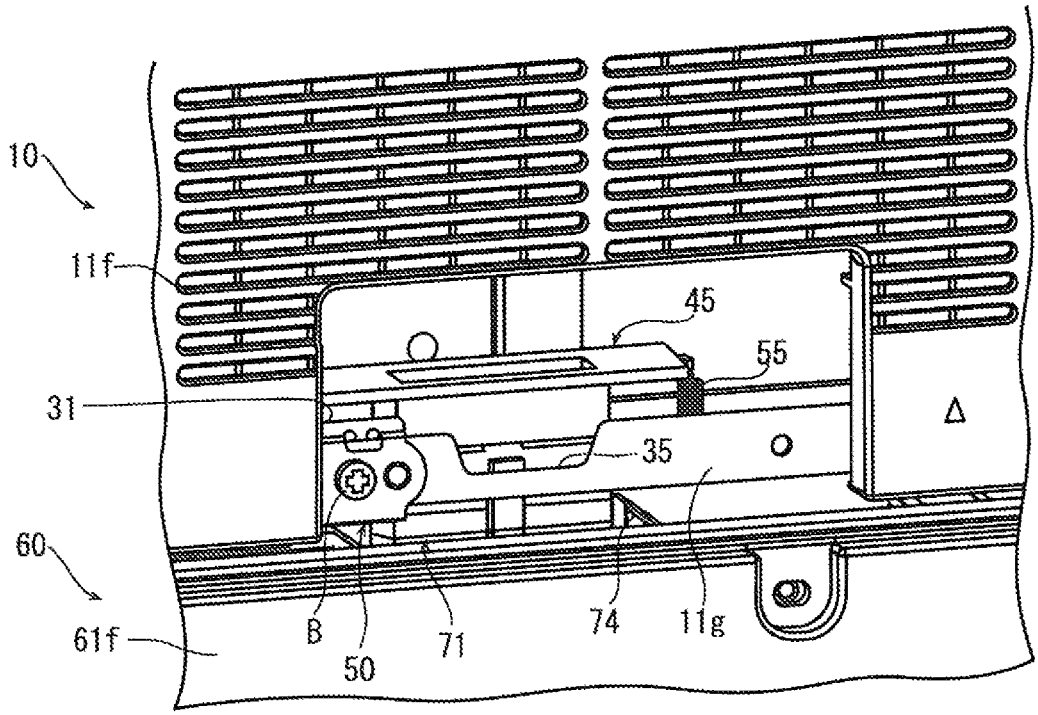
Figure 9:
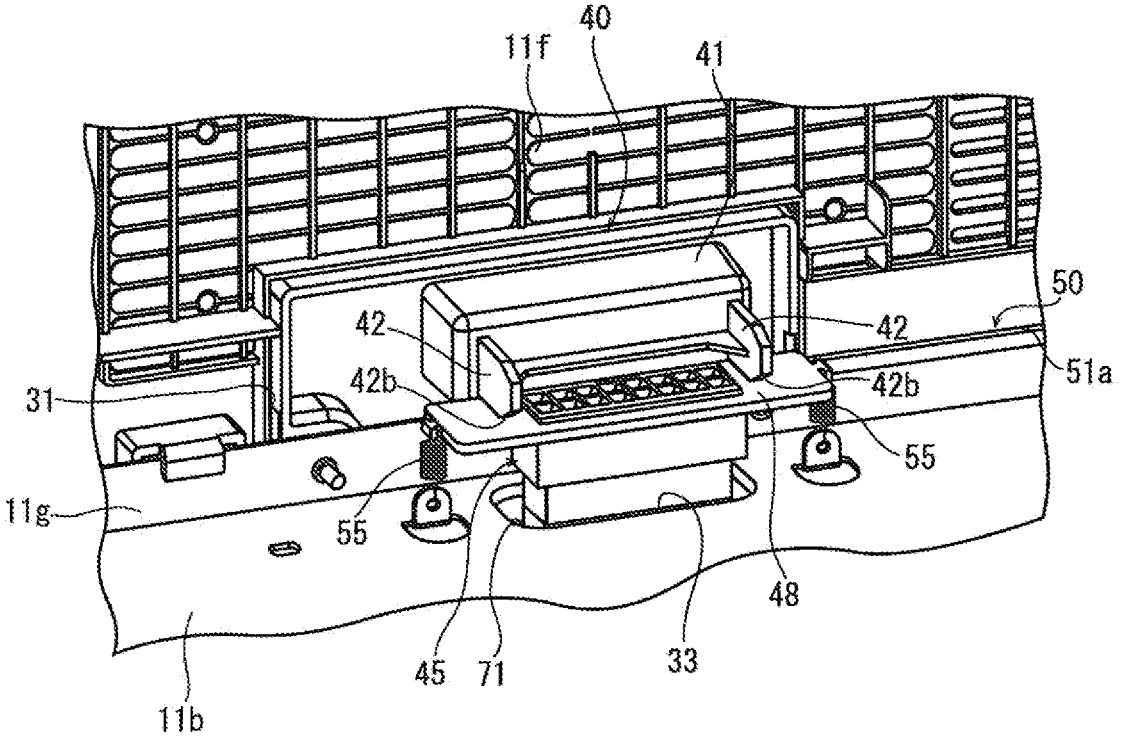
FIG. 9 is a perspective view showing the printer, in a situation where connectors of the apparatus main body part and sheet feed unit are connected, as viewed from the inside of the apparatus main body part, in accordance with the embodiment of the present disclosure.

A way of installing the sheet feed unit 60 to the apparatus main body part 10 in the printer 1 having the above-mentioned configuration will be described with reference to FIGS. 2, 3, 8 and 9. FIGS. 8A and 8B are perspective views showing the apparatus main body part, in respective situations where the connector cover is closed and where the connector cover is opened, as viewed from the outside of the apparatus main body part. FIG. 9 is a perspective view showing the printer, in a situation where connectors of the apparatus main body part and sheet feed unit are connected, as viewed from the inside of the apparatus main body part.

When installing the sheet feed unit 60, in the apparatus main body part 10, as shown in FIG. 3, first, the screw B is removed and the window cover 40 is removed from the window 31. Thereby, it is possible to confirm the male connector 45 through the window 31 by sight. Since the window cover 40 is removed, the male connector 45 is biased downwardly by the coil spring 55 and pressured against the connector cover 50.

Subsequently, the positions of the aligning holes 29 of the apparatus main body part 10 and the positions of the aligning pins 69 of the sheet feed unit 60 shown in FIG. 2 are aligned, and simultaneously, the male connector 45 visible through the window 31 of the apparatus main body part 10 is aligned with the female connector 71 of the sheet feed unit 60. Moreover, the aligning pins 69 are inserted into the aligning holes 29, and then, the sheet feed unit 60 is installed to the apparatus main body part 10.

Further, as shown in FIG. 8A, in the apparatus main body part 10, the screw fastening the connector cover 50 to the edge part 11*g* of the bottom plate 11*b* of the casing 11 is removed and the connector cover 50 is slid in the left direction. Thereupon, as shown in FIG. 8B, the male connector 45 is biased downwardly by the coil spring 55, and accordingly, moved downwardly toward the female connector 71 of the sheet feed unit 60 through the opening part 33 (refer to FIG. 6, omitted in FIG. 8) of the bottom plate 11*b* of the casing 11, and then, loosely connected to the female connector 71.

Furthermore, the male connector 45 is pressed downwardly by a finger inserted through the window 31 of the rear plate 11*f* of the casing 11 to be securely connected to the female connector 71. Then, the hook part 47 of the male connector 45 is engaged with the hook part 72 of the female connector 71 and these are locked in the connection state. Such a connecting work can be carried out through the notch part 35 formed in the edge part 11*g* of the bottom plate 11*b* of the casing 11 of the apparatus main body part 10. The connector cover 50 is fastened to the edge part 11*g* of the bottom plate 11*b* of the casing 11 at the opening part opened position by the screw B.

Finally, the window 31 is closed by the window cover 40. When the window cover 40 is fitted to the window 31, as shown in FIG. 9, the vertical ribs 42 formed on the face at the backside of the pull 41 of the window cover 40 are inserted above the flange part 48, while the lower tapered faces 42*b* come into contact with an upper face of the flange part 48 of the male connector 45. Thereby, if the connection of the male connector 45 and female connector 71 is insufficient, since the flange part 48 of the male connector 45 is pressured downwardly, the male connector 45 and female connector 71 become securely connected. Incidentally, the vertical ribs 42 acts as a mechanism maintaining and locking the connection state in a case where the connectors are securely connected.

On the other hand, when the sheet feed unit 60 is detached from the apparatus main body part 10, first, after the window cover 40 is removed, the hook part 47 of the male connector 45 is turned by pressing the base end part of the hook part 47 and removed from the hook part 72 of the female connector 71, and thereby, the lock of the hook part 47 and hook part 72 is released. Then, the male connector 45 is extracted from the female connector 71. Now, since the male connector 45 is biased by the coil spring 55 downwardly, the male connector 45 is projected downwardly from the opening part 33 of the bottom plate 11*b* of the casing 11 of the apparatus main body part 10.

Therefore, the male connector 45 is lifted above the bottom plate 11*b* of the casing 11 by the finger inserted through the window 31 and the connector cover 50 is slid to the closed position to close the opening part 33. After that, when the male connector 45 is released, the male connector 45 is biased downwardly by the coil spring 55 and pressured against the connector cover 50.

Subsequently, the window 31 is closed by the window cover 40. When the window cover 40 is fitted to the window 31, the vertical ribs 42 formed on the back face of the pull 41 of the window cover 40 are inserted below the flange part 48 while the upper tapered faces 42*a* come into contact with the lower face of the flange part 48 of the male connector 45. Thereby, the flange part 48 of the male connector 45 is gradually pushed upwardly. Then, the male connector 45 is maintained in a posture being not connected to the connector cover 50, or alternatively, in a posture being pressured to the connector cover 50 by an extremely weak force.

As described above, in accordance with the image forming apparatus according to the embodiment of the present disclosure, when the sheet feed unit 60 is installed to the apparatus main body part 10, it is possible to align the male connector 45 of the apparatus main body part 10 with the female connector 71 of the sheet feed unit 60 while confirming the position of male connector 45 through the window 31 formed in the casing of the apparatus main body part 10. Therefore, it is possible to carry out the installing work efficiently and in a comfortable posture.

Moreover, since the connector cover 50 is provided in the male connector 45, it is possible to prevent the male connector 45 from adhesion of dust and unprepared contact with protrusion and others of the sheet feed unit 60. When the connector cover 50 is opened, the male connector 45 is pressured downwardly by the coil spring 55 and comes into loose contact with the female connector 71. After that, by pressing the male connector 45, since the male connector 55 can be securely connected to the female connector 71, the connecting work by manpower becomes easy. Since the connector cover 50 can be slid in the left and right directions along the edge part 11*g* of the bottom plate 11*b* of the casing 11, it is possible to open and close the connecting part of the male connector 45 by simple work. Since it is unnecessary to remove the connector cover 50 from the casing 11 even after opening the opening part 33 of the casing 11, it is unnecessary to consider measures to keeping and loss of the connector cover 50.

In addition, since the connection state of the male connector 45 and female connector 71 is maintained by the window cover 40, the electrical connection of the apparatus main body part 10 and sheet feed unit 60 can be securely maintained.

The embodiment was described in a case of applying the configuration of the present disclosure to the printer 1. On the other hand, in another embodiment, the configuration of the disclosure may be applied to another image forming apparatus, such as a copying machine, a facsimile or a multifunction peripheral, except for the printer 1.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. An image forming apparatus comprising:

an apparatus main body part including an image forming part; and a sheet feed unit installed below the apparatus main body part, wherein the apparatus main body part and sheet feed unit include connector parts electrically connecting the apparatus main body part and sheet feed unit in a bottom face and a top face respectively, the connector part at a side of the apparatus main body part includes:

a window formed at a side face of the apparatus main body part;

a first connector main body located at a position visible through the window and having an electrical connection port facing to the sheet feed unit;

a connector cover covering openably/closably the electrical connection port of the first connector main body; and a biasing member biasing the first connector main body downwardly, the connector part at a side of the sheet feed unit includes:

a second connector main body positioned below the first connector main body and electrically connected to the first connector main body, the first connector main body is pressured downwardly with respect to the connector cover by the biasing member, when the connector cover is closed.

2. The image forming apparatus according to claim 1, wherein the connector cover is arranged so as to be slidable between a position to cover the connecting part of the first connector main body and a position to be withdrawn from the connecting part and to expose the connecting part.

3. The image forming apparatus according to claim 2, wherein the connector cover is configured so as to be slid by handling through the window.

4. The image forming apparatus according to claim 1, wherein the connector part at the side of the apparatus main body part has a window cover covering openably/closably the window, the window cover has a rib pressuring the first connector main body with respect to the second connector main body when the window cover covers the window under a connection state of the first connector main body with second connector main body, and then, maintaining the connection state.

5. The image forming apparatus according to claim 4, wherein the rib supports the first connector main body against a biasing force of the biasing member when the window cover covers the window under a state where the sheet feed unit is not installed to the apparatus main body part.

* * * * *